United States Patent [19]

Stramer

[11] Patent Number: 4,621,807

[45] Date of Patent: Nov. 11, 1986

[54] LEG AND HIP EXERCISING APPARATUS

[75] Inventor: Raymond F. Stramer, Watkins, Iowa

[73] Assignee: Universal Gym Equipment, Inc., Cedar Rapids, Iowa

[21] Appl. No.: 614,339

[22] Filed: May 25, 1984

[51] Int. Cl.[4] ..... A63B 21/06

[52] U.S. Cl. ..... 272/117; 272/118; 272/DIG. 4

[58] Field of Search ..... 272/118, 130, 134, 144, 272/72, 117, DIG. 4, 132, 136, 140, 142, 123; 128/25 R

[56] References Cited

U.S. PATENT DOCUMENTS

| | | | |
|---|---|---|---|
| 1,572,281 | 2/1926 | Fry | 272/132 |
| 2,777,439 | 1/1957 | Tuttle | 128/25 R |
| 3,708,167 | 1/1973 | Potgieter | 272/134 X |
| 3,912,263 | 10/1975 | Yatso | 272/118 |
| 4,200,279 | 4/1980 | Lambert, Jr. | 272/118 |
| 4,296,924 | 10/1981 | Anzaldua et al. | 272/134 X |
| 4,373,717 | 2/1983 | Lambert, Jr. | 272/118 X |
| 4,387,893 | 6/1983 | Baldwin | 272/118 |
| 4,411,424 | 10/1983 | Barnett | 272/118 |
| 4,456,245 | 6/1984 | Baldwin | 272/118 |
| 4,478,411 | 10/1984 | Baldwin | 272/118 |
| 4,500,089 | 2/1985 | Jones | 272/117 |

*Primary Examiner*—Richard J. Apley
*Assistant Examiner*—Robert W. Bahr
*Attorney, Agent, or Firm*—Darby & Darby

[57] ABSTRACT

A rotatable exercise mechanism for interacting with the body in order to perform exercises. The rotatable exercise mechanism includes a pulley mounted on the frame. A cable is secured to the pulley such that the cable can be wound in opposite directions about the pulley. As the pulley is rotated in either a clockwise or counterclockwise direction, the cable is both paid out from and wound onto the pulley. An adjustable resistive force is supplied for interacting with the cable being wound onto or paid out from the pulley. A crank for applying a rotative force to the pulley is also supplied. The pulley is rotated by applying a rotative force to the pulley capable of overcoming the resistive force applied to the cable.

16 Claims, 4 Drawing Figures

LEG AND HIP EXERCISING APPARATUS

FIELD OF THE INVENTION

This invention relates to an exercising apparatus for physical development of the hip and leg.

BACKGROUND OF THE INVENTION

The importance of physical exercise to good health has long been recognized. Consequently, many devices have been developed for exercising various parts of the body. There are four standard exercises for the development and/or rehabilitation of the hips, thighs, and buttocks. Hip flexion develops the hip flexors, psoas iliacus, and quadriceps in the front of the hip and thigh. Hip extension exercises the gluteus muscles and the hamstrings. Abduction is used to develop the gluteus medius and maximus muscles in the outer thigh. Adduction exercises and shapes inner thigh muscles including the abductor brevis, longus, magnus, and pictineas.

Traditional apparatus for the hip flexion and extension exercises utilize an uncomfortable "spread eagle" position for the user. Traditional adductor and abductor machines require a seated position and include some hip flexion in adductor and abductor movements. Therefore it is desirable to have an exercising apparatus with which a user can perform each of the four exercises.

OBJECTS OF THE INVENTION

It is an object of the present invention to provide an exercising apparatus which permits an individual to perform each of the four hip and thigh exercises independently and in a comfortable, standing position.

It is a further object to provide an exercise machine for the hips, thighs and buttocks having a rotatable mechanism capable of supplying an adjustable resistive force in both a clockwise and counter-clockwise direction from an initial static position.

Another object is to provide a machine for exercising the legs, hips and buttocks in which a user operates a rotatable member which is connected to an adjustable resistive force in either a clockwise or counterclockwise direction.

A further object is to provide an exercise machine for the legs, hips and buttocks which has a high degree of adjustability and which can be operated from a comfortable, standing position.

SUMMARY OF THE INVENTION

These and other objects of the invention are met by providing an exercising machine including a pulley rotatably mounted on a frame. The pulley has a crank arm which is adjustable in height, outward extension from the machine and angle of rotation which the user engages to apply a rotational force. A cable is wound over the pulley and each end of the cable is coupled to an adjustable resistance in the form of a weight stack. As the pulley is rotated in either a clockwise or counterclockwise direction from its static position by the user applying force to the crank arm, the cable is either paid out from and wound onto the pulley. As the user rotates the pulley the weight stack is lifted to provide the exercise action.

BRIEF DESCRIPTIONS OF THE DRAWINGS

Other objects and advantages of the present invention will become more apparent upon reference to the following specification and annexed drawing in which.

DESCRIPTION OF THE PREFERRED EMBODIMENT

Figure 1:
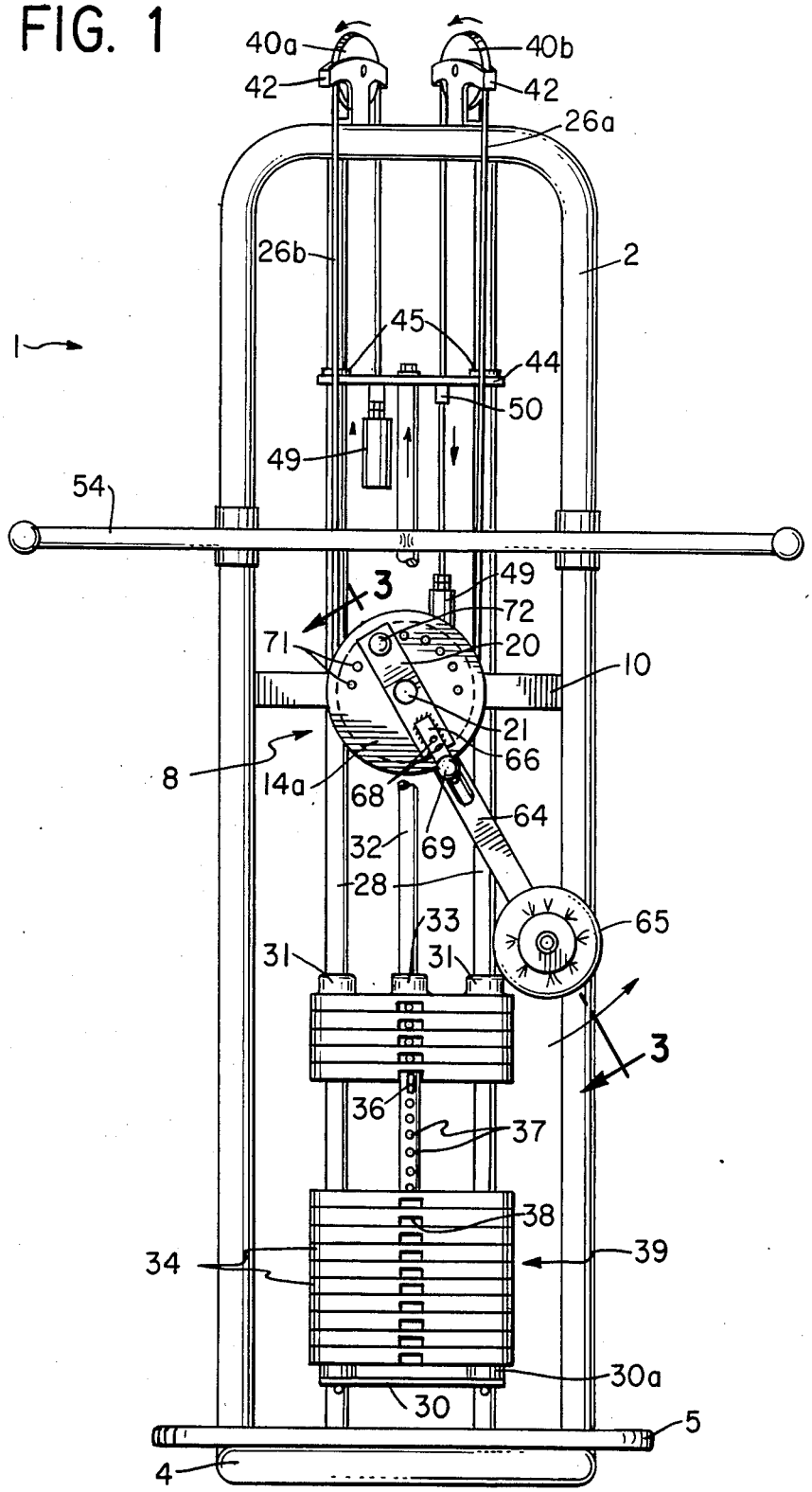
FIG. 1 is a front elevational view of a preferred embodiment of the exercise machine of the present invention.
Figure 2:
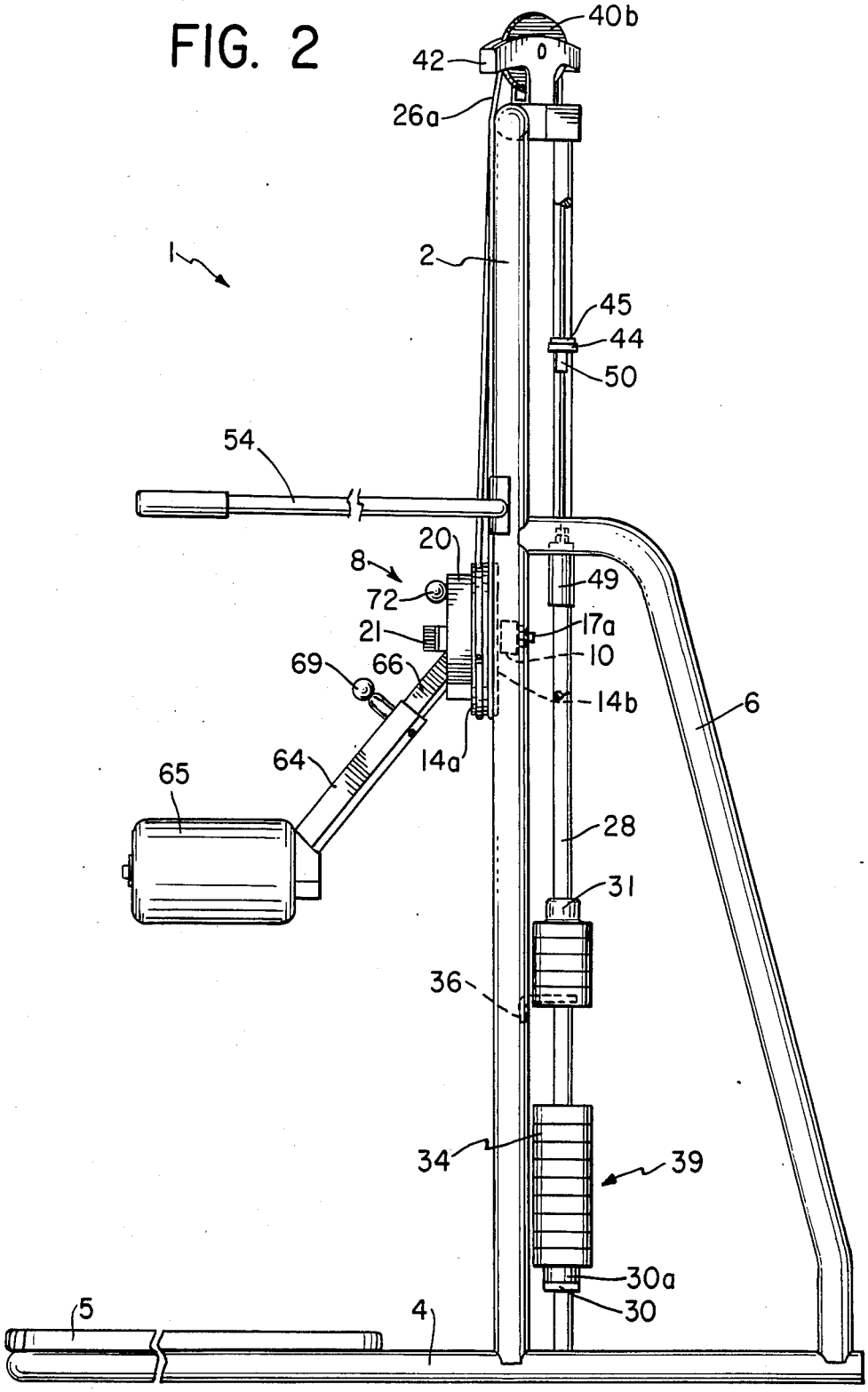
FIG. 2 is a side elevational view of the machine.
Figure 3:
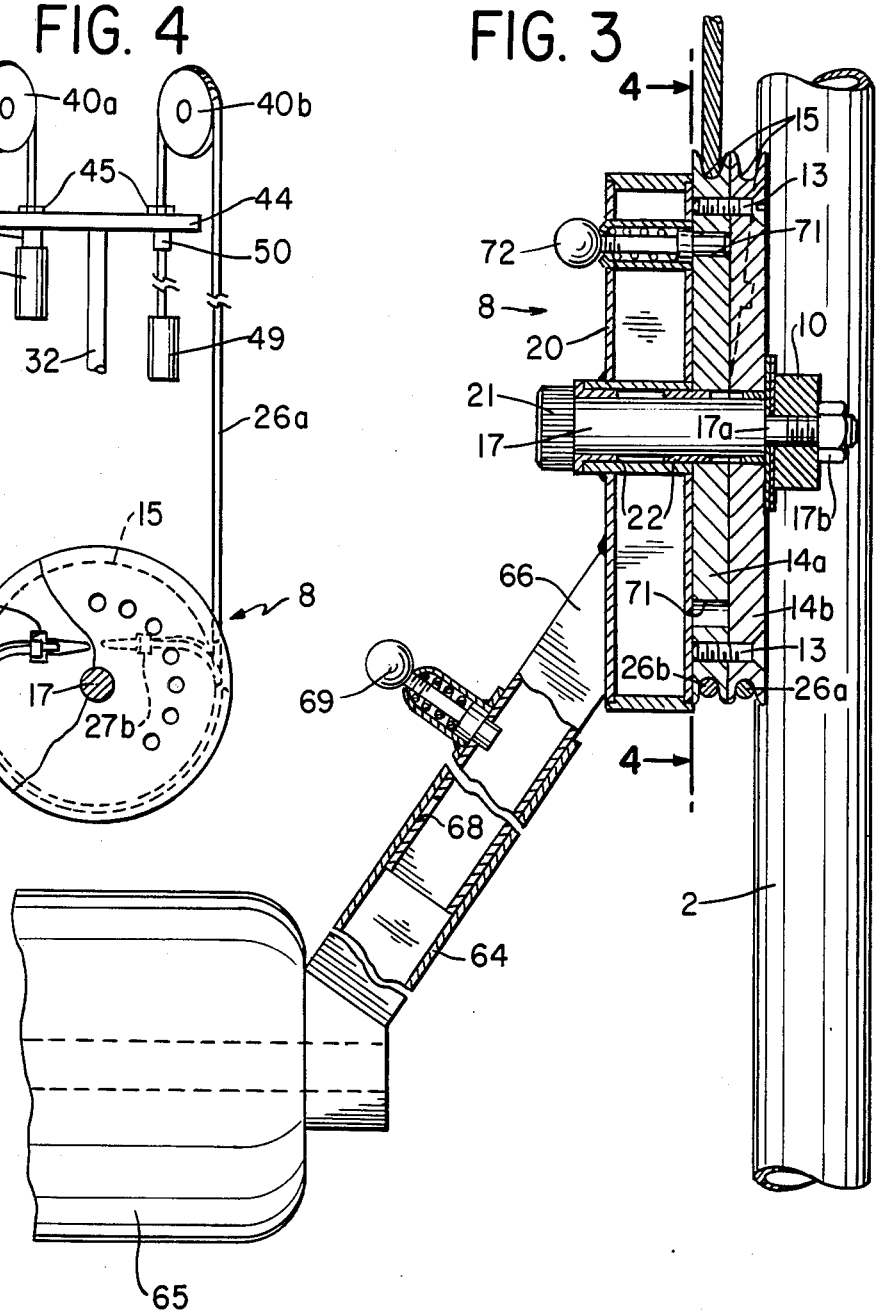
FIG. 3 is a cross-section of the pulley and crank arm assembly.

Referring to FIGS. 1–3, there is shown a leg and hip exercising apparatus 1 having a vertical U-shaped frame 2 mounted perpendicularly on a generally rectangular base frame 4 which rests on the floor. The vertical frame 2 is supported by a side brace 6 on each side which is connected to the base frame 4. A platform 5 is mounted on the base frame to provide a place for the user to stand when exercising. The platform preferably has a non-slip surface.

A pulley assembly 8 is rotatably mounted vertically through its central axis of rotation on a horizontal crosspiece 10 which is secured to the uprights of the vertical frame 2. The pulley assembly is rotatably mounted on a shaft 17 secured to crossbar 10 by a bolt **17*a* at the end of the shaft and a nut 17*b*. The rear section of the pulley assembly 8 is formed by front and rear plates 14*a*, 14*b* of equal diameter. Each plate 14 has a diameter in the range of from about 12 to about 18 inches, although any suitable diameter can be used, and is made of any suitable material such as steel, aluminum, plastic, or other durable material. The periphery of each plate 14 has a semicircular groove 15 therein of a sufficient width and depth to accommodate the cable used with the machine. The two plates 14*a*, 14*b* are secured together by any suitable fasteners such as bolts 13**.

The pulley assembly 8 also includes selector bar 20 which is rotatable relative to the front pulley plate **14*a*. The pulley assembly also has a cap 21 which covers the exposed end of shaft 17. Bearings 22, for example of TEFLON or other suitable material, are provided between the shaft 17 and both the cover 20 and the pulley plates 14*a*, 14*b*. The plates 14*a*, 14*b*** and the cover rotate as a unit on these bearings.

A pair of vertical weight stack guide runners 28 are mounted (FIG. 1) between the top horizontal crosspiece of the vertical frame 2 and a cross piece (not shown) which extends across the base frame member 4. The vertical guide rods 28 are spaced apart by about the diameter of the plates 14 of the pulley assembly, but any suitable spacing is satisfactory. A weight stack support platform 30 is mounted to the guide rods near the bottom of the frame. A plurality of pads **30*a* of rubber or other resilient material are mounted on the top of the support platform 30** to absorb the shock when weights drop onto the platform plate.

A weight stack 39 formed by a plurality of stackable weight plates 34, is provided. Each weight plate has three apertures, with the vertical guide rods 28 passing through the pair of outer apertures 31. A selector shaft 32 extends through the central aperture 33 of each weight plate. The selector shaft has a plurality of vertically spaced holes 37. Each weight plate has a notch 38 at a point opposite the selector shaft 32. With all of the weight plates stacked in a rest position, a selector key 36 is inserted into the notch 38 of one of the plates to engage a corresponding aperture in the selector shaft 37. By varying the placement of selector key 36, the effective weight of the stack 39 can be adjusted to include from none to all of the stackable weight plates 34 to be lifted by the selector shaft.

A pair of secondary pulleys 40*a*, 40*b* are mounted on the horizontal top piece of the vertical frame 2 in respective brackets 42 which include a shield to keep the cable wound around the pulley 40 from coming out. The pulleys 40 are spaced apart by approximately the diameter of the plates 14 of the pulley assembly 8. The plane of each of the pulleys 40 is angled outwardly toward the closest respective vertical frame member by about 45° relative to the top piece of the frame. This permits the cable leaving each pulley to exit closer to the center of the pulley assembly.

Figure 4:
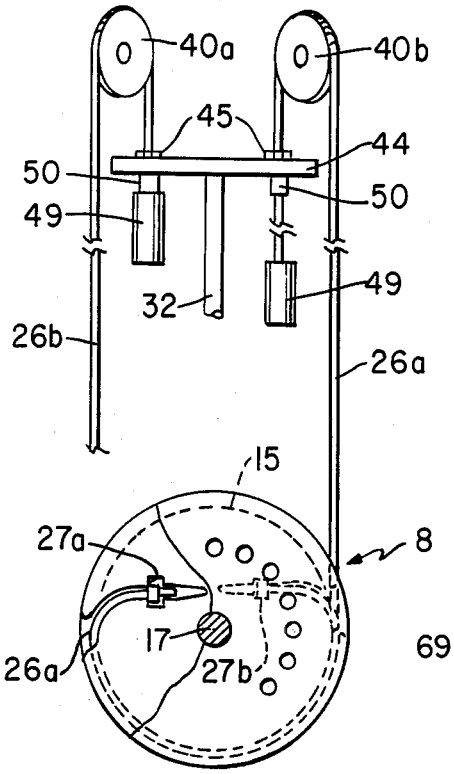
FIG. 4 is an schematic view of the front of the exercise machine showing the cable winding path.

Referring to FIG. 4, a first cable 26*a* is wound clockwise around frontr plate 14*a* for somewhat over about 180° and its terminus is secured by a clamp type fastener 27*a* to the front plate 14*a*. A second cable 26*b* is wound counter-clockwise about the back plate 14*b* and is secured to the back plate by fastener 17*b*. Any appropriate cable winding pattern can be used. To reduce noise and eliminate the need for lubrication, the cables 26 can be plastic covered.

Each cable extends upwardly and passes over the corresponding secondary pulleys 40*a*, 40*b*. Each cable then runs downwardly through a respective aperture in lifting bar 44. The top end of this weight selector shaft 32 is connected to the lifting bar 44. The lifting bar 44 rides over the vertical guide rods 28 on bushings 45 are provided in the lifting bar apertures.

A respective counterweight 49 is attached to the free end of each cable 26*a*,26*b* to keep it taut. This also aids in keeping each cable tracked within the grooves of the secondary pulleys 40 and the grooves 15 of the plates 14 of the main pulley 8. A stop 50 is formed on the top of each counterweight and has a cross-sectional dimension larger than opening in the lift bar bushing 45.

An adjustable crank arm 64 is provided for the user to transmit rotative force to the pulley assembly 8. The crank arm 64 is a sleeve slides over a shaft 66 which is mounted at an angle to the selector bar 20 of the pulley assembly. A padded roller 65 is rotatably mounted on the end of the crank arm 64. The roller 65 extends horizontally outwardly from the machine so that it can be engaged by the user. Shaft 66 has a number of holes 68 spaced longitudinally along its length. A spring loaded push pin 69 is mounted on the crash arm 64. As the arm 64 is moved along the shaft 66, its position can be locked relative to the shaft 66 by placing the push pin into one of the holes 68 on shaft 6*b*. In this manner, the height of the roller 65 above the ground is adjusted for different height users.

To control the exercise stroke, that is, the amount that the pulley assembly 8 can be rotated by the user while the weight stack is lifted, the angular position of the crank arm 64 is adjustable. This is accomplished by providing a plurality of apertures 71 in the pulley assembly. A spring loaded push pin 72 is attached to the selector bar 20. By rotating the selector bar 20 and locating the pin 72 in one of the apertures 71 in the plate 14*a*, the angular position of the crank arm 64 can be set, either clockwise or counterclockwise of the vertical centerline of the machine.

The weight lifting operation of the machine is now describe. In the static position both counterweights 49 are located a short distance directly below lifting bar 44 by equal amounts. The user sets the angular position of the crank arm 64 by rotating selected bar 20 and using push pin 72 by moving the arm 64 along shaft 66 and locking pin 69 and its height. The user then engages the roller 65 with the appropriate portion of his or her body, depending upon the type of exercise to be performed, and rotates the pulley assembly 8 either clockwise or counterclockwise as the user may be choose. For example, as the main pulley 8 is rotated clockwise, cable 16*b* is paid out and its counterweight 49*b* is lowered due to the gravitional force on the counterweight. Cable 16*a* is reeled and its corresponding counterweight 49*a* is raised. The stop 50 on counterweight 49*a* engages the lifting bar 44. Continued rotation of the main pulley 8 by the user reels in cable 16*a* further and continues to raise counterweight 49*a*. As counterweight 49*a* rises, it moves the lifting base 44 upwardly over runners 28. This raises the selector shaft 32 and the weights 34 of the weight stack 39 which are connected to it. The weight stack raising action continues until the user stops applying the rotative force. The horizontal top rail of the frame is set high enough so that it normally will not be contacted by the lift bar. As the user rotates the pulley, he is accomplishing the exercise function. A handlebar 54 is connected to the frame at a suitable height above main pulley 8 to allow the user to maintain his balance while performing the exercises.

If the pulley assembly 8 is rotated counter-clockwise the cable 18*a* is paid out and cable 18*b* reeled in. This causes counterweight 49*b* to raise and engage the lifting bar 44 to raise the weight stack as the pulley is rotated further. As noted previously, the amount of weight to be lifted is set by the selector key 32.

When the rotative force is removed from the main pulley 8, the weight stack will move down carrying the lifting bar 44 with it. This also moves the counterweight engaging the weight stack down until the point where it is released from the lifting bar and it continues to drop of its own weight. This action reels in the cable which has been paid out and pays out the one which has been reeled in. The static position of the machine is achieved when lifting bar 44 has returned to its rest position, that is, when all of the weight plates of the weight stack are on the support platform 30. Overall, the forces on the cables by the weights are such that the pulley is always being urged towards its static position thereby providing resistive rotative force in both the clockwise and counterclockwise direction.

As seen, the exercise member of the invention is highly versatile since the amount of resistive force can be easily adjusted as can the height of the crank arm and the amount of its rotation. Also, the force can be applied in either a clockwise or counter-clockwise direction while the user is in a standing position. Thus, a variety of exercises can be easily performed.

What is claimed:

1. An exercise machine comprising;

a frame;

a rotatable pulley means mounted to the frame;

cable means wound in opposite directions about the pulley means so that as the pulley means is rotated in either a clockwise or counter-clockwise direction said cable means is both unwound from and wound onto said pulley means;

weight resistive means;

means for interacting said cable means with said weight resistive means such that a resistive force can be provided when said pulley means is rotated in either a clockwise or counter-clockwise direction from an initial static position;

and means interacting with said pulley means for engagement by a user to apply a rotative force to the pulley means, to overcome the resistive force.

2. An exercise machine as in claim 1 wherein said weight resistive means comprises a weight stack, said means interacting said cable means with said weight stack comprising a selector shaft for carrying said weight stack and means for coupling said cable means to said selector shaft such that as the cable means is unwound and wound onto said pulley means said selector shaft is raised and/or lowered.

3. The machine of claim 1 wherein said cable means comprises two separate lengths each wound around said pulley means in a direction opposite to the other, the other end of of each cable length being coupled to said resistive means.

4. A machine as in claim 3 wherein said weight resistive means comprises a weight stack, said means interacting said cable means with said weight stack comprising a selector shaft for carrying said weight stack and means for coupling the other end of each said cable length to said selector shaft such that as the respective cable length is reeled in the selector shaft is raised to raise the weight stack.

5. A machine as in claim 4 wherein said coupling means for the other end of each cable length comprises a lifting bar to which said selector shaft is attached, and means at the other end of each cable length for engaging said lifting bar.

6. A machine as in claim 5 wherein said engaging means to the other end of each cable length comprises a counterweight which also keeps the cable length taut.

7. The machine of claim 1 wherein said means for applying a rotative force to said pulley comprises a crank arm connected to said pulley means.

8. An exercise machine as in claim 7 wherein said crank arm extends outwardly at an angle from said pulley means, such crank arm having a free end for engagement by the user.

9. An exercise machine as in claim 8 further comprising means for adjusting the height of the user engaging each of said crank arms relative to said pulley means.

10. An exercise machine as in claim 9 further comprising means for adapting the angular rotational position of said crank arm relative to said pulley means.

11. A leg and hip exercising apparatus comprising:

a frame having a horizontal base and a vertical section;

a pulley mounted to the frame;

two cables, one end of each secured to the pulley such that the cables can be wound in opposite directions about the pulley, the other end of each cable terminating in a vertically traveling counterweight and cable stop:

a plurality of stackable weights, slidably mounted to the frame;

a lifting bar slidably mounted to the frame, having two separate apertures for surrounding the cables, positioned directly above the cable stops, each aperture being large enough to allow passage of the cable but not large enough to allow passage of the cable stop, said lifting bar additionally having means for incrementally securing said weights thereto; and means for applying a rotative force to the pulley, sid rotative force applied in either a clockwise or counter-clockwise direction resulting in one cable being wound off the pulley, and its respective counterweight and cable stop being lowered in response to gravity, and the other cable being wound onto the pulley, its respective counterweight and cable stop being raised until said cable stop contacts the lifting bar and any additional stacked weights secured thereto, at which point the rotative force must be increased by an amount equal to the downward force applied by the lifting bar to the rising counterweight.

12. The exercising apparatus of claim 11 additionally comprising a platform on the horizontal base and a handlebar on the vertical frame section.

13. The exercising apparatus of claim 11 wherein said means for applying a rotative force to said pulley comprises a crank rotatably mounted to said pulley, said crank comprising an extendable arm terminating in a padded roller.

14. The exercising apparatus of claim 3 wherein said means for applying a rotative force to said pulley comprises a crank rotatably mounted to said pulley, said crank comprising an extendable arm terminating in a padded roller.

15. The exercising apparatus of claim 5 wherein said means for applying a rotative force to said pulley comprises a crank rotatably mounted to said pulley, said crank comprising an extendable arm terminating in a padded roller.

16. The exercising apparatus of claim 5 further comprising a platform and a handlebar, each mounted to said frame.

* * * * *